United States Patent [19]

Torikai

[11] 4,129,164

[45] Dec. 12, 1978

[54] VACUUM FORMING OR REDUCED-PRESSURE MOULDING

[75] Inventor: Kiyoshige Torikai, Mihara, Japan

[73] Assignee: Mitsubishi Jukogyo Kabushiki Kaisha, Tokyo, Japan

[21] Appl. No.: 762,184

[22] Filed: Jan. 24, 1977

[30] Foreign Application Priority Data

Mar. 15, 1976 [JP] Japan ..... 51-29891[U]

[51] Int. Cl.[2] ..... B22C 15/22; B22D 27/16; B22D 47/02

[52] U.S. Cl. ..... 164/7; 164/65; 164/160; 164/167; 164/255; 164/322

[58] Field of Search ..... 164/7, 65, 160, 253, 164/254, 255, 379, 121, 167, 322, 323, 324, 325, 329

[56] References Cited

U.S. PATENT DOCUMENTS

| | | | |
|---|---|---|---|
| 3,825,058 | 7/1974 | Miura et al. | 164/65 X |
| 3,843,301 | 10/1974 | Hijikota et al. | 164/160 X |
| 3,861,447 | 1/1975 | Hondo | 164/160 X |
| 3,933,194 | 1/1976 | Hijikota et al. | 164/160 |
| 4,028,455 | 6/1977 | Ueda et al. | 164/7 X |

*Primary Examiner*—Francis S. Husar
*Assistant Examiner*—Gus T. Hampilos
*Attorney, Agent, or Firm*—Wenderoth, Lind & Ponack

[57] ABSTRACT

In a method for reduced-pressure mould production, a plurality of mould flasks are simultaneously evacuated by evacuating means, and in which production of the moulds is carried out while moving the mould flasks sequentially through a mould shaping position, a pouring position and a mould disintegrating position. Evacuation is effected by first evacuating means during a period from the beginning of mould shaping to the beginning of mould pouring and a period after pouring, and evacuation is effected more strongly by second evacuating means during the period of pouring.

4 Claims, 5 Drawing Figures

VACUUM FORMING OR REDUCED-PRESSURE MOULDING

BACKGROUND OF THE INVENTION

The present invention relates to improvements in vacuum forming or reduced-pressure moulding.

In vacuum forming or reduced-pressure moulding production methods known heretofore, a surface of a gas-permeable pattern is covered with an air-tight plastics film which has been previously softened by heating. The pattern is placed on a gas-permeable surface plate provided with an evacuating chamber, and evacuation is then effected so as to pull the plastics film tightly onto the surface of the pattern. For reduced-pressure moulding, a flask is placed over the surface plate to enclose the pattern and the plastics film fitted thereon. Solid particles, such as moulding sand, not containing a binder are then fed into the flask so as to surround the pattern, and these particles are aggregated together over the plastics film, which is then caused to adhere to the aggregated particles by evacuating the interior of the flask. The pattern is subsequently removed from the interior of the flask, whereby a mould cavity section covered with the plastics film is formed.

Also it is common known practice for efficient production from the moulds, to evacuate a plurality of mould flasks simultaneously by evacuating means normally comprising one or more vacuum pumps and a reservoir, and to move the mould flasks repeatedly through a mould shaping position, a pouring position, and a mould disintegrating position.

A mould produced according to the above-mentioned method requires a maxium air suction rate (degree of evacuation) when molten metal is poured into the mould. However, the mould does not require such a high degree of evacuation during short periods, for example a few minutes, respectively, before and after pouring of the molten metal. If a plurality of flasks are simultaneously evacuated by the evacuating means and these flasks are then moved sequentially through a mould shaping position, a pouring position and a mould disintegrating position and back to the initial mould shaping position as described above, then at any instant the air-tight film of the flask which has been moved to the mould pouring position is burnt out by contact with the molten metal, and thereby the air-tightness of this flask is reduced. Accordingly, the air suction rate from the interior of the flask to the evacuating means greatly increases, resulting in a lowering of the degree of evacuation in the other flasks which are also being evacuated by the evacuating means. Consequently, there has been a problem that moulds produced within the other flasks have been subjected to deformation or damage. To solve this problem, a method has been employed in which the evacuating capability has been enhanced by the use of a plurality of vacuum pumps as mentioned above, or by the use of a vacuum pump having a large capacity. However, even with this method, it has been found that the insufficient air suction rate cannot be supplemented, and especially in the case where the pouring speed is lowered, it has resulted in the production of defective cast products.

SUMMARY OF THE INVENTION

An object of the present invention is to provide an alternative solution for resolving the above-mentioned problem in the prior art.

According to one aspect of the present invention, a method for reduced-pressure mould production in which a plurality of mould flasks are simultaneously evacuated by evacuating means, and in which production of the moulds is carried out while moving the mould flasks sequentially through a mould shaping position, a pouring position and a mould disintegrating position, is characterized in that evacuation is effected by first evacuating means during a period from the beginning of mould shaping to the beginning of mould pouring and a period after pouring, and in that evacuation is effected more strongly by second evacuating means during the period of pouring.

According to another aspect of the invention, reduced-pressure moulding apparatus of the kind comprising a plurality of mould flasks arranged for sequential movement through a mould shaping position, a pouring position and a mould disintegrating position, and evacuating means arranged for simultaneously effecting evacuation of a plurality of mould flasks, is characterized in that the evacuating means comprise two sources of vacuum, one of which is stronger than the other, the weaker vacuum source being connectable to the plurality of mould flasks, and the stronger vacuum source being connectable to each mould flask in the mould pouring position, and in that means are associated with the mould flasks whereby the weaker vacuum source is closed-off from each mould flask in the mould pouring position.

By use of the method and apparatus of the invention it is possible to ensure that a mould flask that is being poured with molten metal is maintained at an optimum degree of evacuation independently of the other mould flasks, and that the other mould flasks are maintained at an optimum degree of evacuation independently of the mould flask being poured with molten metal. In this way deformation or damage of the moulds such as has occurred in the past with prior art methods can be prevented.

According to a feature of the invention, a mould flask for reduced-pressure moulding apparatus according to the invention, is characterized in that the flask comprises a main body provided at opposite sides thereof with first and second evacuation chambers partitioned by mesh screens, first and second suction conduits in communication with respective evacuation chambers, and first and second check valves disposed at those ends of respective suction conduits which connect into the evacuation chambers, the check valves being operable in such manner that when the interior of the flask main body is connected only to the weaker vacuum source, the first check valve is caused to open and the second check valve caused to close, while when the interior of the flask main body is connected also to the stronger vacuum source the stronger vacuum causes the second check valve to open and the first check valve to close thereby closing-off the weaker vacuum source.

By use of such a mould flask, switching from the first evacuating means to the second evacuating means and from the second evacuating means to the first evacuating means can be effected automatically and continuously as the mould flask moves through its operating positions.

BRIEF DESCRIPTION OF THE DRAWINGS

In order that the invention will be readily understood and that further features thereof will be made apparent, one embodiment of a reduced-pressure moulding apparatus, and the method of production therefrom, will now be described, by way of example, with reference to the accompanying drawings in which.

DETAILED DESCRIPTION OF THE INVENTION

Figure 1:
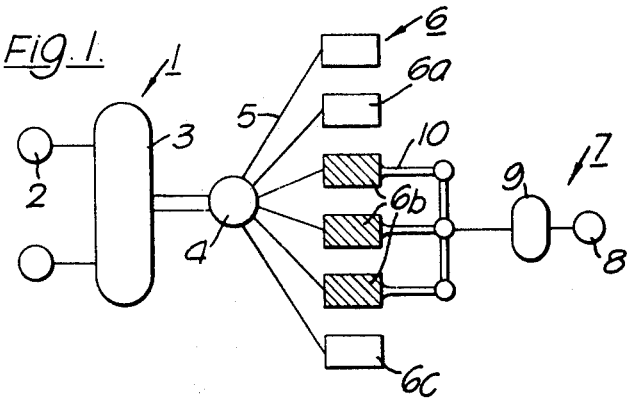
FIG. 1 is a schematic view of the preferred embodiment.

Referring to FIG. 1, a reduced-pressure moulding apparatus includes a first evacuating device 1, which device comprises a vacuum pump 2 and a reservoir 3, and a manifold 4 which connects reservoir 3 to first suction conduits 5. A plurality of flasks 6 for reduced-pressure mould production are connected to manifold 4 via respective suction conduits 5. Reference numeral 7 generally designates a second evacuating device which also comprises a vacuum pump 8 and a reservoir 9. It is to be noted that the second evacuating device 7 has a greater suction power than the first evacuating device 1. Second suction conduits 10 are connected to the reservoir 9 and these suction conduits are adapted to be detachably connected to those flasks referenced 6*b* which are in the act of being poured with molten metal and which are represented in the Figure by the hatched blocks. Their function will be described hereinafter. Those flasks referenced 6*a* represent moulds being shaped prior to pouring, while that flask referenced 6*c* represents a flask just after pouring has been completed in a mould disintegrating position.

Figure 2:
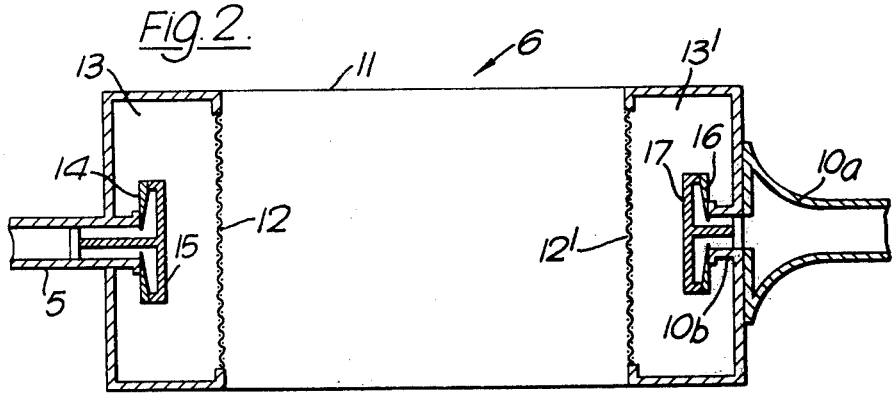
FIG. 2 is a longitudinal cross-sectional view showing one preferred form of flask for the apparatus of FIG. 1.

Referring now to FIG. 2, each flask 6 for reduced-pressure mould production comprises a main body 11 having a first evacuation chamber 13 partitioned by a wire gauze 12, and a second evacuation chamber 13' partitioned by a wire gauze 12', such wire gauzes having an appropriate mesh size. The first suction conduit 5 extending from the manifold 4 is attached to one end of the main body 11 so as to open into the first evacuation chamber 13, and a check valve base 15 is mounted at the open end of suction conduit 5 and supports a first check valve 14. A suction conduit 10*b* is attached to the opposite end face of the main body 11, and its open end has a check valve base 17 mounted thereon which supports a second check valve 16. The respective check valves 14 and 16 are formed from sheets of hide, natural rubber, or synthetic rubber such as polypropylene or nylon, singly or as a mixture of these materials.

Figure 3:
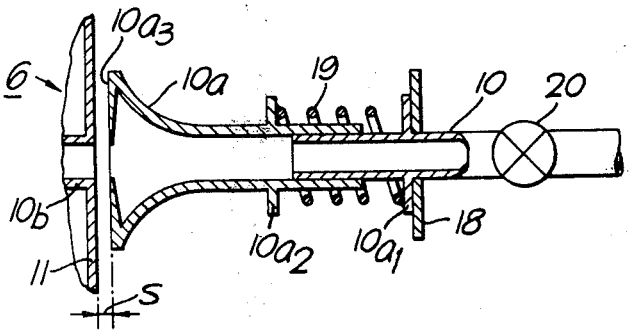
FIG. 3 is a longitudinal cross-sectional view showing one preferred form of second suction conduit for the apparatus of FIG. 1, and FIGS. 4 and 5 are longitudinal cross-sectional views similar to FIG. 2, but showing the flask in two different operating conditions.

Referring now to FIG. 3, the second suction conduit 10 has a flange $10a_1$, by which it is supported from a beam 18, the flange $10a_1$ being fixedly secured to beam 18. A further suction conduit 10*a* is slidably and air-tightly fitted to a tip end of the conduit 10. The suction conduit 10*a* is provided centrally with another flange $10a_2$, and at its tip end a suction-adhesive surface $10a_3$ is formed. A helical spring 19 encircles the conduits 10, 10*a* and its opposite ends are fixedly secured to the flanges $10a_1$ and $10a_2$. A three-way cock valve 20 is provided in the conduit 10 and the arrangement is such that, when a flask 6 moves into the pouring position and the suction conduit 10*b* is aligned with the suction conduit 10*a*, a gap (S) is left between the flask 6 and the suction-adhesive surface $10a_3$. The three-way valve 20 is then operated to bring the suction conduit 10*a* into communication with a second evacuating device connected to the right end of the suction conduit 10, whereupon the suction conduit 10*a* is urged towards the flask 6 against the bias of the spring 19. The suction-adhesive surface $10a_3$ is thus brought into tight contact with the flask wall 6 and thereby the suction conduits 10*a* and 10*b* are brought into communication with each other. It is to be noted that the first suction conduits 5 are made of flexible heat-resistive material such as metal, rubber, synthetic rubber, etc. in order to permit free movement of the flasks 6. In addition, the flasks 6 are adapted to be transferred to predetermined positions by means of a transfer device such as roller conveyors or trucks, or the like (not shown).

Figure 4:
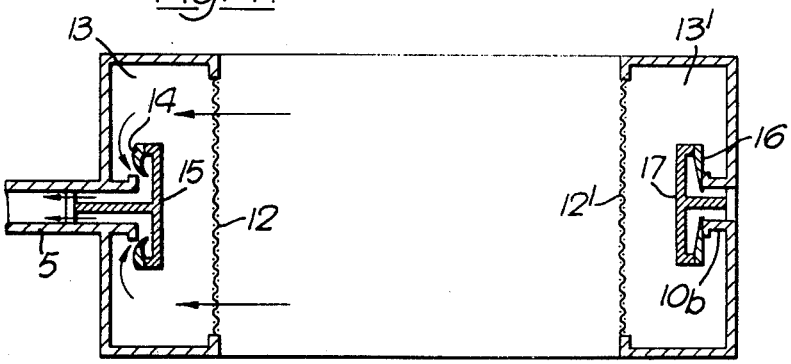
Figure 5:
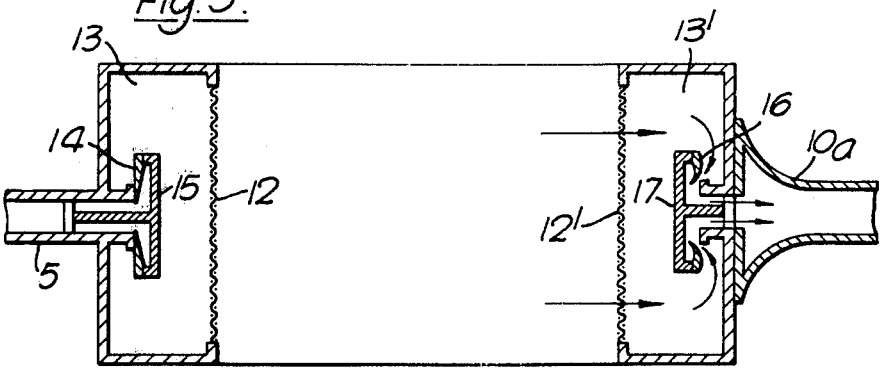

The operation of the first and second evacuating devices 1 and 7 and the flask 6 for reduced-pressure mould production, will now be described. A flask 6 in which disintegration of a mould has been completed, is moved to the mould shaping position, where a mould 6*a* (see FIG. 1) is shaped in a conventional manner. The interior of the flask 6*a* is then evacuated by the first evacuating device 1 and, consequently, air within the flask is removed in the direction of the arrows in FIG. 4, so that the first check valve 14 is opened, while the second check valve 16 is closed. Subsequently, the flask is moved to the pouring position 6*b* (see FIG. 1). During this time, the interior of the flask is being evacuated continuously by the first evacuating device 1. However, in the pouring position, the suction conduits 10 and 10*a* are in communication with the second evacuating device 7 and by appropriate operation of the three-way valve 20 the suction conduit 10*a* is urged towards flask 6 against the resilient force of the spring 19 to bring the suction-adhesive surface $10a_3$ into tight contact with the flask 6 and hence connect the suction conduit 10*b* to the second evacuating device 7 via suction conduits 10*a* and 10. Air within flask 6*b* is thereby removed in the direction of the arrows in FIG. 5, so as to close the first check valve 14 and open the second check valve 16. It will thus be appreciated that switching from the first evacuating device 1 to the second evacuating device is carried out automatically and continuously, just prior to the commencement of a pouring operation. When the pouring operation has been completed, the three-way valve 20 is operated to bring the interior of the suction conduit 10*a* into communication with the atmosphere. In response to this operation, the adhesive force on the suction-adhesive surface $10a_3$ is released and the suction conduit 10*a* is thereby disengaged from the flask wall by the resilient force of the spring 19. Also, while the first evacuating device 1 was unable to remove air from the flask due to the suction conduit 10*a* being connected to the suction conduit 10*b* and hence causing first check valve 14 to be closed as described above, when the suction conduit 10*a* is opened to atmosphere, the first evacuating device 1 becomes effective once more to remove air from the flask as shown by the arrows in FIG. 4, so as to open the first check valve 14 and close the second check valve 16. Thus, it will also be appreciated that switching from the second evacuating device 7 to the first evacuating device 1 is effected automatically and continuously after pouring.

When the suction conduit 10*a* is disengaged from the flask 6*b* and the flask is being evacuated by the first evacuating device 1, the flask is then moved to the mould disintegrating position 6*c* (see FIG. 1), where it continues to be evacuated by the first evacuating device for a few minutes. After this period has elapsed, the mould is disintegrated in a conventional manner and the moulded product taken out. The flask 6c is then returned to the mould shaping position 6a.

It will be appreciated from the foregoing, that in the reduced-pressure mould production method described the evacuation of the moulds is effected by the first evacuating device 1 from the beginning of mould shaping to the beginning of pouring and for a short period after pouring, while evacuation is effected more strongly by the second evacuating device 7 during pouring. Thus, the flasks 6b being poured with molten metal can be maintained at an optimum degree of evacuation independently of the other flasks 6a and 6c, while such other flasks can also be maintained at their optimum degree of evacuation independently of the flask 6b. Accordingly, deformation or damage to the moulds in their different states can be prevented. In addition, since the flasks are evacuated by switching between the first and second evacuating devices, the capacity of the vacuum pump can be reduced to the minimum necessary value and thereby reduce the expense of installing and running the apparatus. In this way, the present invention can contribute significantly to the efficient production of products utilising a reduced-pressure mould production method.

It will further be appreciated that, with the above-described reduced-pressure mould production method, advantages are obtained by the automatic and continuous switching from the first evacuating device 1 to the second evacuating device 7 and vice versa.

While the present invention has been described above in relation to a preferred embodiment, it should be appreciated that the invention is not limited to such embodiment, but various changes in design can be made without departing from the spirit of the invention, within the scope of the appended Claims:

I claim:

1. In a method of reduced-pressure molding of the type wherein a plurality of mold flasks are sequentially moved along a path through a mold shaping position whereat a mold is formed within each flask, a mold pouring position whereat molten metal is poured into the mold formed within each flask to form a casting, a mold disintegration station whereat the mold in each flask is removed from the casting formed therein, and back to said mold shaping position, and wherein the interiors of said plurality of flasks are subjected to a reduced pressure during movement along said path, the improvement wherein said reduced pressure is applied by the steps comprising:

subjecting the interior of each said flask, during periods of movement thereof along said path through positions other than said mold pouring position, to a first reduced pressure operation of a first, weaker evacuation means; and subjecting the interior of each said flask, only during the period of movement thereof along said path through said mold pouring position, to a second, more reduced pressure by operation of a second, stronger evacuation means.

2. The improvement claimed in claim 1, wherein said first reduced pressure is applied to the interior of each said flast during movement thereof from the beginning of said mold shaping position to the beginning of said mold pouring position, and for a period after the end of said mold pouring position.

3. In an apparatus for reduced-pressure molding, said apparatus being of the type including a plurality of mold flasks arranged for sequential movement along a path through a mold shaping position whereat a mold is formed within each flask, a mold pouring position whereat molten metal is poured into the mold formed within each flask to form a casting, a mold disintegration position whereat the mold in each flask is removed from the casting formed therein, and back to said mold shaping position, and means for simultaneously evacuating said flasks during movement thereof along said path, the improvement wherein said evacuating means comprises:

first, weaker evacuation means, connected to all of said flasks during all positions of movement thereof along said path, for subjecting the interior of each said flask to a first reduced pressure;

each said flask having associated therewith means for blocking communication of said first reduced pressure to the interior of said flask when said flask is passing through said mold pouring position of said path; and second evacuation means, stronger than said first evacuation means and connected to said flasks only during the movement thereof through said mold pouring position of said path, for subjecting the interior of each said flask to a second, more reduced pressure.

4. The improvement claimed in claim 3, wherein each said flask comprises a main body having on opposite sides thereof first and second evacuation chambers partitioned by screens; said first evacuation means comprises a first vacuum source and first suction conduits connecting said first vacuum source to each of said first evacuation chambers; said second evacuation means comprises a second vacuum source stronger than said first vacuum source and second suction conduits connecting said second vacuum source to said evacuation chambers only when the respective flasks are moving through said mold pouring position of said path; and said blocking means of each said flask comprises first and second check valves positioned within said first and second evacuation chambers, respectively, said first and second check valves being operable such that when said flask is in a position other than said mold pouring position said first vacuum source causes said first check valve to open and said second check valve to close, and such that when said flask is at said mold pouring position said second stronger vacuum source causes said second check valve to open and said first check valve to close.

* * * * *